United States Patent [19]

Potesta

[11] Patent Number: 4,811,441

[45] Date of Patent: Mar. 14, 1989

[54] TOOL FOR TRIMMING HOSE AND INSERTING FITTING

[75] Inventor: Richard E. Potesta, Chesterland, Ohio

[73] Assignee: Stride Tool Inc., a New York Corporation, Washington, D.C.

[21] Appl. No.: 204,745

[22] Filed: Jun. 10, 1988

[51] Int. Cl.[4] ..... B26B 11/00

[52] U.S. Cl. ..... 7/158; 28/237; 28/267; 30/242; 30/280

[58] Field of Search ..... 7/158, 170; 29/235, 29/237, 267; 30/242, 280

[56] References Cited

U.S. PATENT DOCUMENTS 3,164,899 1/1965 Raze .
3,807,046 4/1974 Igyarto et al. .
3,813,756 6/1974 Rigsby et al. .
4,257,135 3/1981 Moebius ..... 29/237 X
4,408,381 10/1983 Kish .
4,412,380 11/1983 Kish .
4,526,070 7/1985 Wiener et al. ..... 30/242 X
4,757,588 7/1988 Churchich ..... 29/235

*Primary Examiner*—James G. Smith
*Attorney, Agent, or Firm*—William N. Hogg

[57] ABSTRACT

A tool for cutting a hose to length and for inserting a fitting into the end of a hose is provided. The tool includes a base which mounts a slide member for reciprocal movement therealong. The slide mounts a knife and a fitting member die, and is actuated by a handle connected by a linkage thereto. The base includes a notch to support a hose for cutting by the blade, and a support and bar engaging cam to retain the hose is positioned to have a fitting inserted therein.

11 Claims, 4 Drawing Sheets

TOOL FOR TRIMMING HOSE AND INSERTING FITTING

BACKGROUND OF THE INVENTION

This invention relates generally to hand tools, and more particularly to a hand tool for both cutting a hose to length and inserting a fitting in the end of a hose.

In the field it is often necessary, when working with hoses, to cut the hoses to length, and to insert fittings into the hoses that are so cut. In the past there have been provided tools that will cut hoses, and other tools that will insert fittings. However, it has been necessary to utilize two separate tools for these operations.

SUMMARY OF THE INVENTION

According to the present invention, a hand tool is provided which has a mechanism which actuates a blade mounted for reciprocal movement to cut a hose to the desired length and which mechanism also actuates a fitting inserting die mounted for reciprocal movement to insert a fitting into the cut or trimmed end of the hose. Separate means are provided to hold the hose in transverse relationship with the blade for cutting the hose and in axial alignment with the fitting insertion die for allowing insertion of a fitting.

DESCRIPTION OF THE PREFERRED EMBODIMENT

Figure 1:
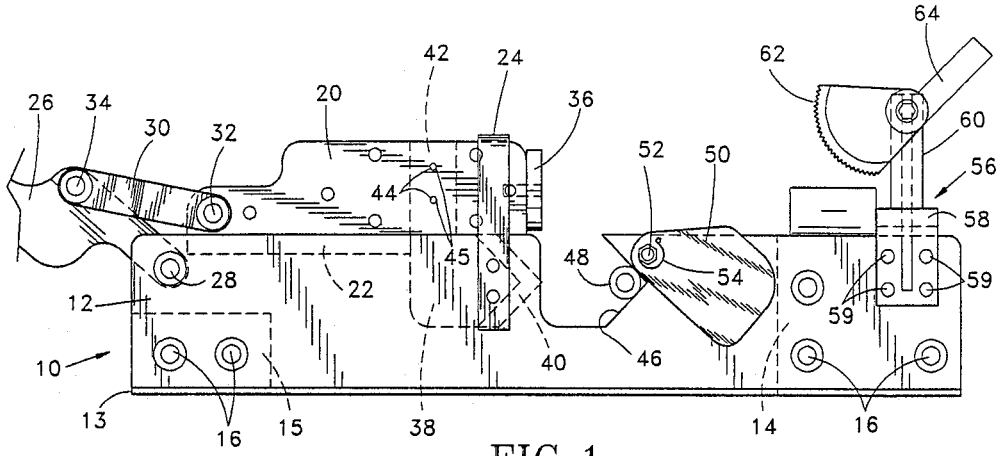
FIG. 1 is a side elevational view of the device in retracted position showing a hose in position to be cut.

Referring now to the drawings, a hand tool for cutting hose and inserting fittings therein according to this invention is shown.

The tool includes a base member 10 formed of a pair of side plates 12 each of the side plates having a mounting flange 13. A pair of spacers 14 and 15 are interposed between the side plates 12. The side plates 12 and spacers 14 and 15 are joined together by rivets 16 to form between said side plates a channel 18. A slide member 20 is provided having a downwardly depending guide 22 which is slidably carried in the channel 18, thus mounting said slide member 20 for reciprocal movement on said base member 10. A "U" shaped strap 24 guides the slide member 20 and acts as a retainer to retain it in position on top of and in contact with the base member 10.

An actuating handle 26 is provided which is pivotally mounted at one end thereof by a pivot pin 28 to the base member 10. A bifurcated link 30 is pivotally connected at one end thereof to one end of the slide member 20 by a pivot pin 32, and has its other pivotally connected to the handle intermediate the ends of the handle by a pivot pin 34. Actuation of the handle will reciprocally drive the slide member 20 along the base member between a retracted position shown in FIGS. 1 and 3, and an actuated position shown in FIGS. 2 and 4.

The end of the slide member 20 is provided with a removable fitting insertion die 36 which is adapted to coact with a fitting to insert the fitting in the end of a hose. An 'L' shaped knife member 38 has a cutting blade 40 disposed within the channel 18 and an attachment end 42 secured to the slide member 20 by spring pins 44 extending through holes 45 in the slide member. Each of the side plates 12 has a "V"-shaped notch 46, which notches together serve to receive a hose 48 as shown in FIG. 1 with the axis of the hose oriented transverse to the path of travel of the knife 38 carried by the slide 20. A bifurcated shield 50 is pivotally mounted on the hose 10 by a bolt 52 and is normally biased into the closed position (FIGS. 3 and 4) by a coil spring 54.

The hose member 10 also has mounted thereon a hose clamping member 56. This clamping member includes a V-shaped hose support bracket 58 mounted on the base 10 by rivets 59.

Figure 3:
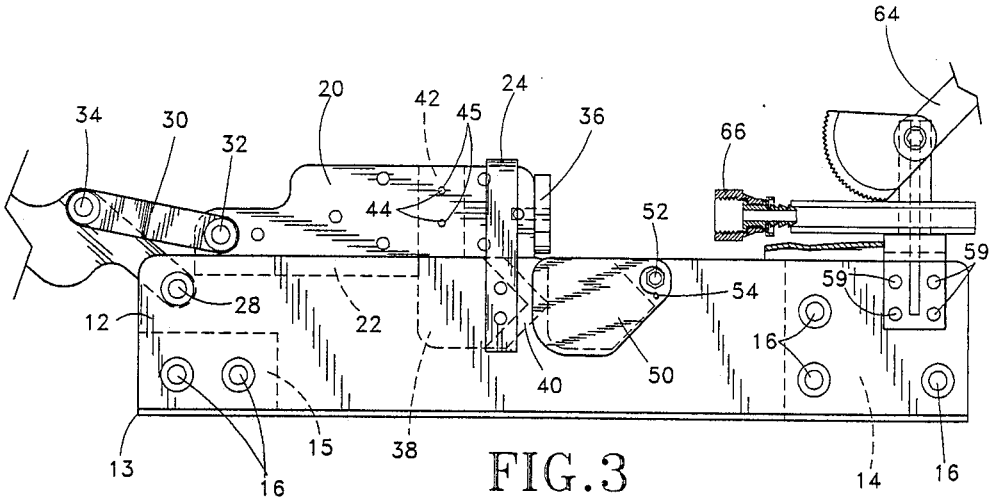
FIG. 3 is the device of FIG. 1 in its retracted position showing a hose in position for insertion of a fitting.
Figure 4:
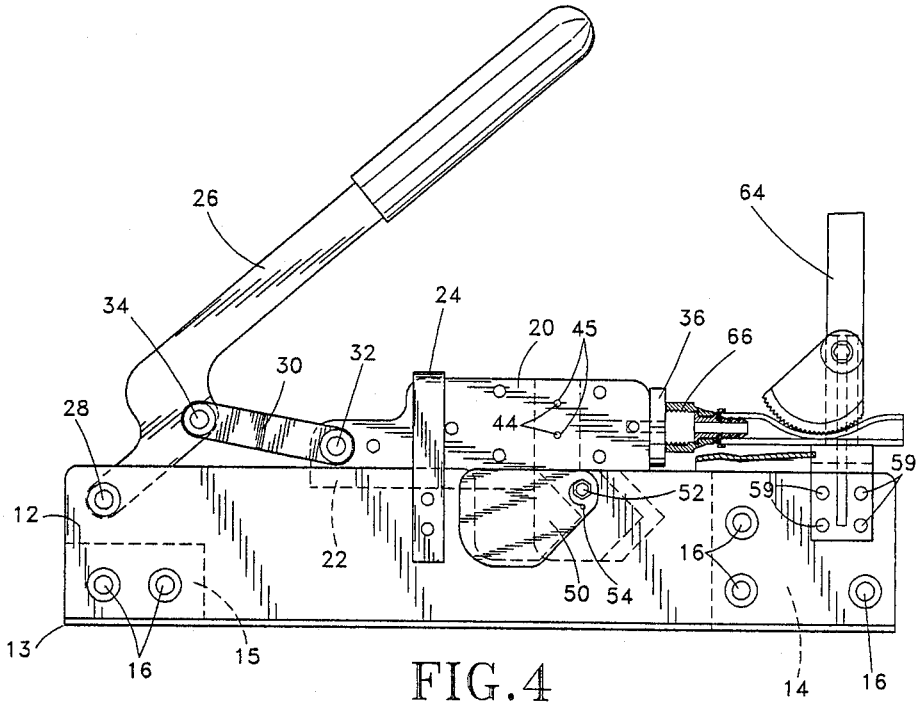
FIG. 4 is the device of FIG. 3 in its actuated position showing the fitting having been inserted.
Figure 5:
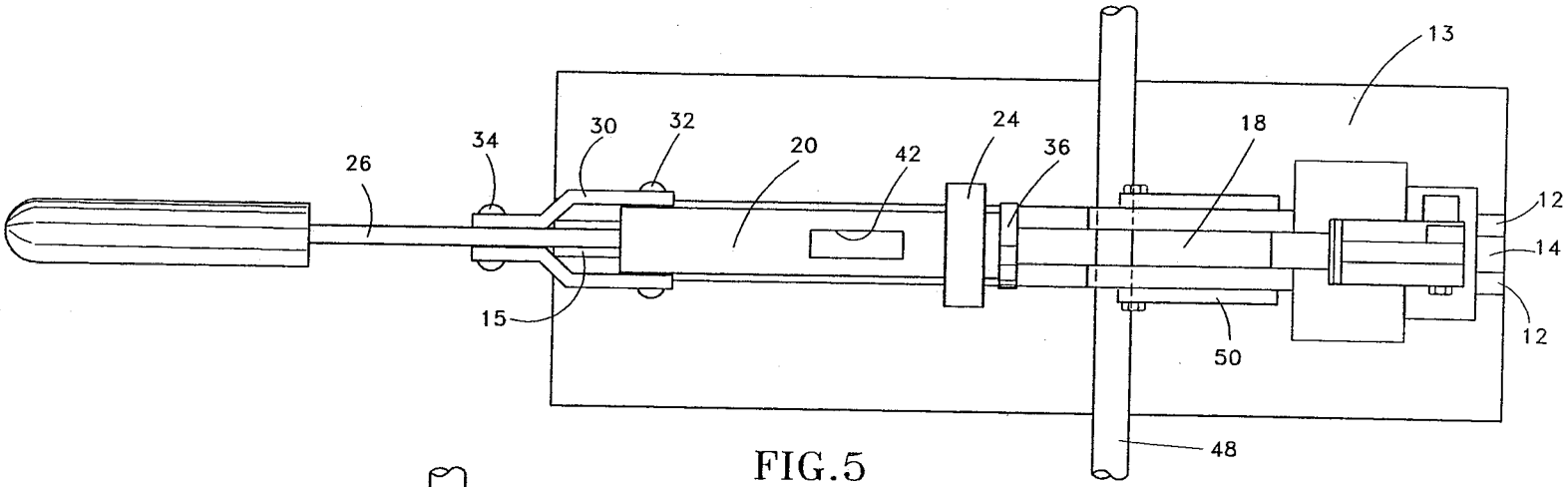
FIG. 5 is a plan view of the device of FIG. 1.

An arm 60 extends upwardly from the V-shaped support bracket and pivotally mounts a serrated cam or eccentric 62. The V bracket 58 and cam 62 coact to support a hose with its axis lying on the path of travel of the fitting insertion die carried by the slide member as shown in FIGS. 3 and 4. A lever 64 extends from the cam 62 for actuation of the cam to engage the cam with the hose (as shown in FIG. 3) and to disengage the cam when the fitting has been inserted.

OPERATION

In one facet of its operation, the tool is used to cut hose to the desired length, and then in another facet of operation, the tool is used to insert a fitting into the end of a hose of the desired length.

Figure 2:
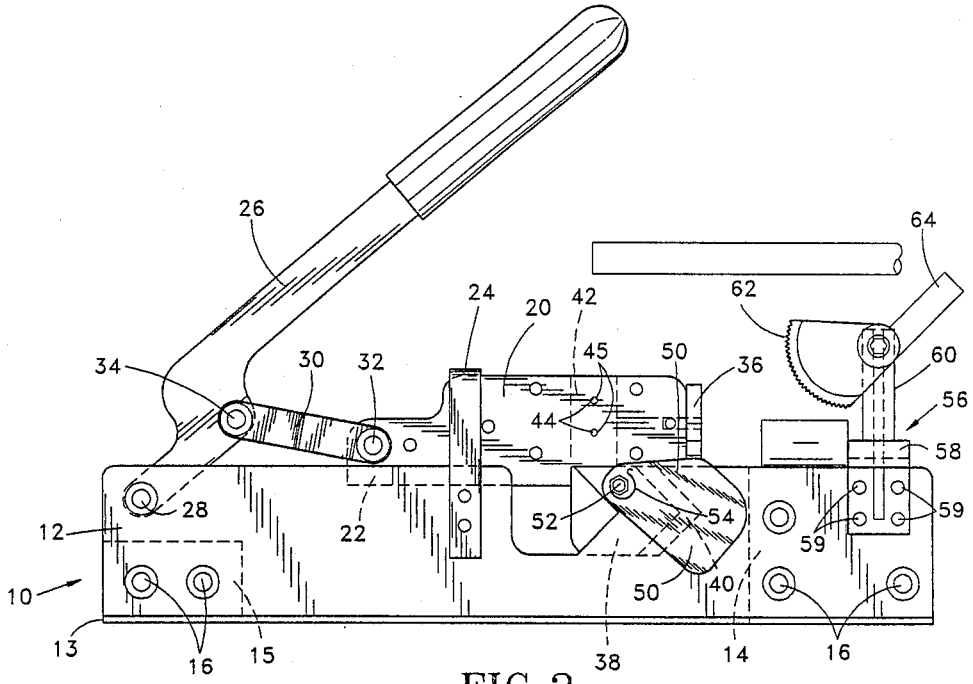
FIG. 2 is the device of FIG. 1 in its actuated position wherein the hose has been cut.
Figure 6:
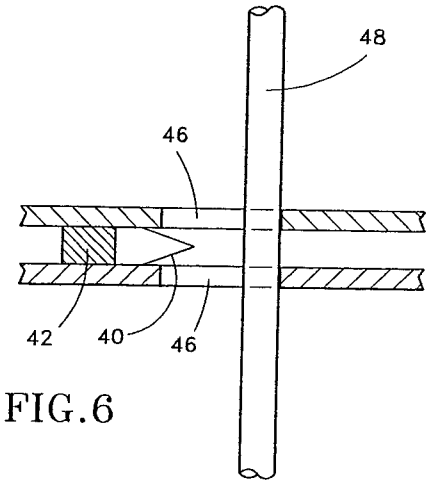
FIG. 6 is a detail plan view somewhat diagrammatic of the cutting blade and supporting structure in the retracted position.
Figure 7:
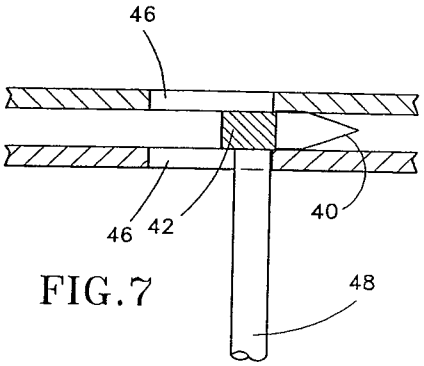
FIG. 7 is a detailed plan view similar to FIG. 6 with the cutting blade in its actuated position.

To cut a hose, the shield 50 is rotated to expose notches 46, and the hose 48 is inserted therein with its axis transverse to the path of travel of the slide member 20 with the handle mounting the slide member 20 and knife cutting blade 40 rotated to the retracted position as shown in FIGS. 1 and 6. The handle is then rotated to move the slide 20 to the actuated position shown in FIG. 2. This will drive the slide 48 to the right which will move the knife member 38 in the channel 18 to the actuated position causing the blade to sever the hose 48 to the desired length as shown in FIGS. 2 and 7. The handle 26 is then rotated back to the retracted position and the hose removed, allowing the shield to rotate back to the position shown in FIG. 3. To insert a fitting 66 into the hose, the hose is placed in the clampling member 56 and the cam 62 is rotated by means of lever 64 to engage and hold the hose with its axis lying on the path of travel of the slide member, with the handle 26 in the retracted position as shown in FIG. 3. A fitting 66 is partially inserted into the end of the hose and the handle 26 rotated to move the slide member 20 to its actuated position as shown in FIG. 4. The action of the fitting insertion die 36 in cooperation with the hose clamping member 56 forces the fitting snugly and firmly into the end of the hose 48 as shown in FIG. 4. The handle 26 is then rotated to move the slide member 20 back to its retracted position and the lever 64 is operated to release the hose and the operation is completed.

Figure 8:
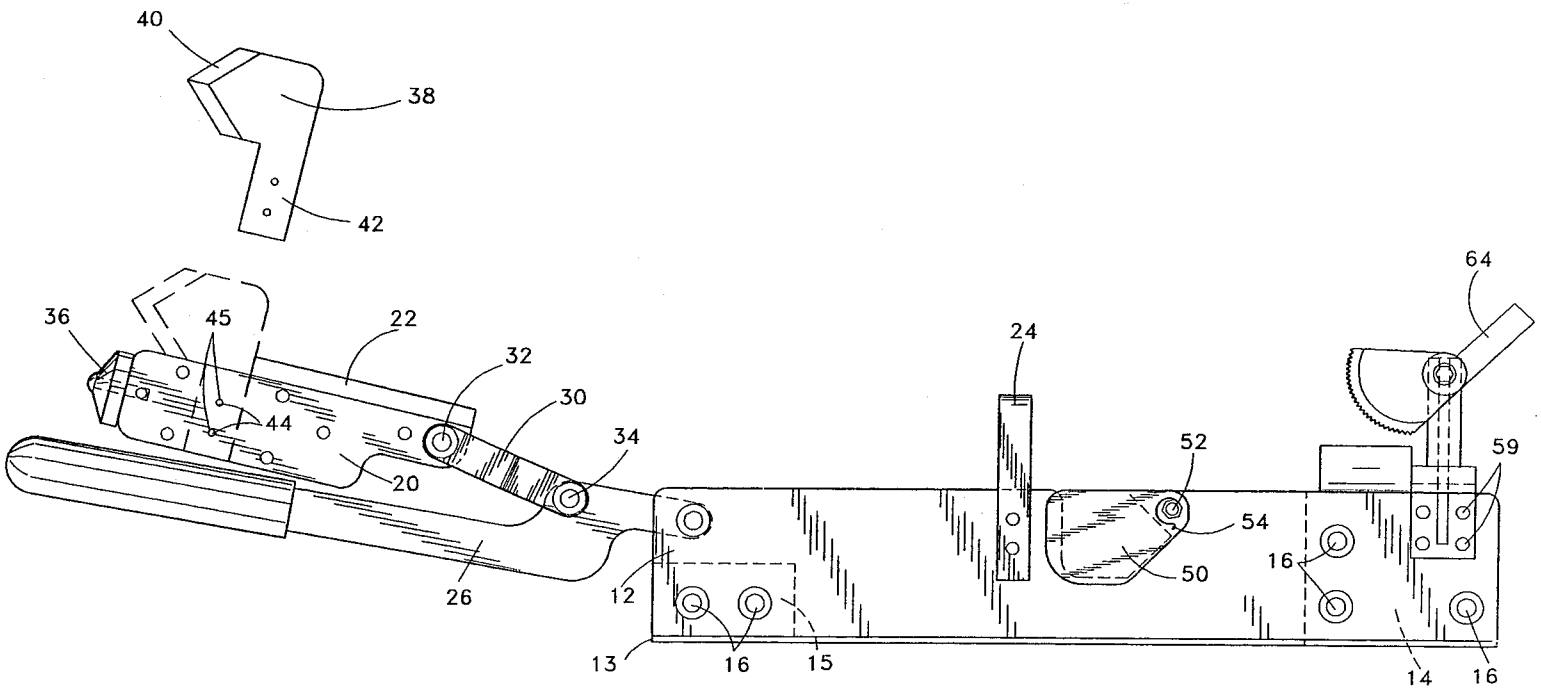
FIG. 8 is a side elevational view of the device shown in a position for replacing the knife.

On occasion it is necessary to remove and replace the knife member 38. This particular construction makes this easy to accomplish, as shown in FIG. 8. After first removing the fitting insertion die 36 the handle can be further rotated past the retracted positon by means of an over center movement of the link 30, which moves the slide member further to the left and past the confines of the strap 24 to a disengaged position. This allows the slide member 20 to pivot about the pivot pin 32 (connecting it to the link 30) raising the knife member out of the channel 18. To replace the knife, the spring pins 44 are removed from the holes 45 which frees the knife member 38, which can then be replaced with the desired replacement knife.

While one embodiment of the invention has been shown and described, various modifications and adaptations can be made without departing from the scope of the invention.

What is claimed is:

1. A tool for trimming a hose and assembling a fitting in said hose comprising:

a base member, a cutting blade mounted for movement on a path of travel on said base member between a retracted position and an actuated position, means to support a hose to be but on the base member on said path of travel in a configuration with the axis of the hose transverse to said path of travel, a fitting insertion die mounted on said base member and reciprocally movable on a path between a retracted position and an actuated position, means carried by said base to secure a hose with its axis extending substantially along the path of travel of said fitting insertion die and in alignment with said die;

and handle means operatively associated with said base member and said cutting blade and said fitting insertion die to move both said fitting insertion die and said cutting blade between their respective actuated and retracted positions.

2. The invention as defined in claim 1, wherein a common slide member both said cutting blade and said fitting insertion die on said base.

3. The invention as defined in claim 2, wherein a common handle member operates said slide member.

4. The invention as defined in claim 3, wherein the handle member is pivotally connected to said base, and connected to said common slide member through link means.

5. The invention as defined in claim 1, wherein the means to secure the hose includes a cam member rotatably mounted to said base and configured to increase its force on the hose responsive to movement of the hose one way on the path of travel of the fitting insertion die and to decrease its force on the hose responsive to movement of the hose in the other direction on the path of travel with the fitting insertion die.

6. The invention as defined in claim 2, wherein the base member includes a pair of side members interconnected to form a channel therebetween; and wherein the cutting blade is slidably mounted in said channel.

7. The invention as defined in claim 6, said further characterized by a guard means carried by said base member mounted for movement between a position which blocks entrance of a hose to the means to support the hose for cutting, and an open position which allows insertion of a hose to the means to support the hose for cutting.

8. The invention as defined in claim 1, further characterized by means to move said cutting blade a position spaced from said base member whereby to allow replacement of said cutting blade.

9. The invention as defined in claim 6, further characterized by retainer means to maintain said slide in contact with said base means during reciprocal movement thereof.

10. The invention as defined in claim 9, wherein linkage means interconnects said handle means and said slide member to move said slide member between the retracted position and the actuated position responsive to movement of said handle.

11. The invention as defined in claim 10, wherein said linkage means is arranged to move to a disengaged position wherein said slide member is removed from said retainer means and is pivotally movable away from said base and move the knife out of said channel for replacement.

* * * * *